US009943207B1

(12) United States Patent
Patterson

(10) Patent No.: US 9,943,207 B1
(45) Date of Patent: Apr. 17, 2018

(54) FLAT MOPS HAVING FOLDING CARRIER PLATES

(71) Applicant: Unger Marketing International, LLC, Bridgeport, CT (US)

(72) Inventor: Joseph K. Patterson, Monroe, CT (US)

(73) Assignee: UNGER MARKETING INTERNATIONAL, LLC, Bridgeport, CT (US)

( * ) Notice: Subject to any disclaimer, the term of this patent is extended or adjusted under 35 U.S.C. 154(b) by 692 days.

(21) Appl. No.: 14/172,930

(22) Filed: Feb. 5, 2014

(51) Int. Cl.
*A47L 13/258* (2006.01)

(52) U.S. Cl.
CPC ..... *A47L 13/258* (2013.01)

(58) Field of Classification Search
None
See application file for complete search history.

(56) References Cited

U.S. PATENT DOCUMENTS

| | | | | |
|---|---|---|---|---|
| 2,840,840 | A | 7/1958 | Yamen | |
| 2,926,373 | A | 3/1960 | Knapp | |
| 3,339,220 | A | 9/1967 | Barry | |
| 3,458,886 | A | 8/1969 | Goettel | |
| 3,843,993 | A | 10/1974 | Leland | |
| D250,245 | S | 11/1978 | Bebb | |
| 4,799,283 | A | 1/1989 | Haydon | |
| 4,845,800 | A * | 7/1989 | Pederson | A47L 13/258 15/147.1 |
| 4,881,290 | A | 11/1989 | Bohacek | |
| 4,991,250 | A | 2/1991 | Young | |
| 5,390,390 | A | 2/1995 | Kresse | |
| 5,815,878 | A | 10/1998 | Murakami | |
| 5,836,039 | A | 11/1998 | Rimer | |
| 5,881,423 | A | 3/1999 | Shumway | |
| 5,926,896 | A | 7/1999 | Allemann | |
| 6,305,046 | B1 | 10/2001 | Kingry | |

(Continued)

FOREIGN PATENT DOCUMENTS

| | | | |
|---|---|---|---|
| CN | 202776205 | U | 3/2013 |
| EP | 1147735 | A2 | 10/2001 |

(Continued)

OTHER PUBLICATIONS

Unger Floor Cleaning System Demo PPG—screenshot, video at link (May 2010, available from https://www.youtube.com/watch?v=DnOLAc7Jhl4).*

(Continued)

*Primary Examiner* — Joseph J Hail
*Assistant Examiner* — Brian Keller
(74) *Attorney, Agent, or Firm* — Ohlandt, Greeley, Ruggiero & Perle, L.L.P.

(57) ABSTRACT

A foldable flat mop is provided that has a pair of carrier plates, which define an unfolded position, a folded position with a minimum distance between the tips of the carrier plates, and a deflected position where the carrier plates are deflected towards one another to reduce the minimum distance between the tips. The foldable flat mop can include one or more biasing members that bias the carrier plates to an intermediate position between the folded and unfolded positions. The carrier plates can have a scissor-like arrangement with the tips of the carrier plates being on an opposite side of the centerline from that pivot axis of that carrier plate.

28 Claims, 13 Drawing Sheets

(56) References Cited

U.S. PATENT DOCUMENTS

| | | | | |
|---|---|---|---|---|
| 6,370,725 | B1 | 4/2002 | Carlson | |
| D465,890 | S | 11/2002 | Rivera | |
| 6,687,943 | B2 | 2/2004 | Zorzo | |
| 6,854,149 | B1 | 2/2005 | Specht | |
| 6,854,150 | B2 | 2/2005 | Hirse | |
| D506,050 | S | 6/2005 | Lalanne | |
| 7,039,969 | B2 | 5/2006 | Zorzo | |
| 7,257,853 | B2 | 8/2007 | Boyer | |
| D563,068 | S | 2/2008 | Jiang | |
| D617,066 | S | 6/2010 | Koenig | |
| D620,214 | S | 7/2010 | Clemen | |
| D625,480 | S | 10/2010 | Raven | |
| D638,186 | S | 5/2011 | Yoon | |
| D638,596 | S | 5/2011 | Vasilakes | |
| 8,065,775 | B2 | 11/2011 | Cameneti | |
| D653,826 | S | 2/2012 | Lee | |
| D657,928 | S | 4/2012 | Byrne | |
| D700,761 | S | 3/2014 | Libman | |
| D723,233 | S | 2/2015 | Gidwell | |
| 2002/0152569 | A1* | 10/2002 | Zorzo | A47L 13/258 15/147.1 |
| 2002/0174501 | A1 | 11/2002 | Specht | |
| 2004/0074520 | A1 | 4/2004 | Truong | |
| 2006/0070196 | A1 | 4/2006 | Lacotta | |
| 2008/0256736 | A1 | 10/2008 | Bonnell | |
| 2010/0064466 | A1 | 3/2010 | Dingert | |
| 2010/0205758 | A1 | 8/2010 | Levitt | |
| 2011/0107538 | A1 | 5/2011 | Lindner | |
| 2012/0073074 | A1 | 3/2012 | Hsu | |
| 2012/0110814 | A1 | 5/2012 | Matola | |
| 2012/0180239 | A1 | 7/2012 | Byrne | |
| 2013/0056027 | A1 | 3/2013 | Young | |

FOREIGN PATENT DOCUMENTS

| | | | |
|---|---|---|---|
| GB | 2229627 | A | 10/1990 |
| WO | 9909876 | A1 | 3/1999 |

OTHER PUBLICATIONS

Unger DualBucket System Video—screenshot, video at link (Oct. 2011, available from https://www.youtube.com/watch?v=eR6e0lWT340).*

Custodial Partners from Aug. 14, 2012 found at https://web.archive.org/web/20120814060615/http://catalog.custodialpartners.com/Items/JMTMCF/Cleaning_Supplies/Mops/Microfiber_Mops/.*

* cited by examiner

FLAT MOPS HAVING FOLDING CARRIER PLATES

BACKGROUND OF THE INVENTION

1. Field of the Invention

The present disclosure is related to flat mops. More particularly, the present disclosure is related to foldable flat mops that have carrier plates that can be easily folded and unfolded by the user.

2. Description of Related Art

There are many different types and styles of mops used for cleaning surfaces such as, but not limited to floors, walls, mirrors, counters, and other surfaces. These mops include devices such as sponge mops, string mops, pocket mops, and flat mops. These mops can use cleaning surfaces made of different materials including, but not limited to, microfiber, cotton, recycled materials, and others.

Flat mops have become increasingly popular for use in commercial, industrial, and residential settings. Generally, flat mops have a carrier and a mopping cloth removably connected to the carrier.

Some flat mops have a foldable carrier, which consists of two plate-like sections hingeably connected to one another for movement between an unfolded position and a folded position. In the unfolded position, the plates form a planar lower surface with the mopping cloth covering at least the lower surface so that the user can clean a surface with the cloth. In the folded position, the plates generally face one another so that the cloth hangs from carrier so that the hanging cleaning cloth can be dipped into a cleaning and/or rinsing solution and can be pressed in a mop press. Once excess fluid has been pressed from the cloth, the carrier can be returned to the unfolded position to continue the mopping process.

It has been determined by the present disclosure that prior art foldable flat mops make it difficult to return the carrier to the unfolded position after dipping and pressing. This difficulty is compounded by the fact that many flat mops are used to mop large or heavily soiled areas, which require the user to repeatedly fold and unfold the carrier.

For example, some prior art foldable flat mops require the user to manually move the plates back to the unfolded position. In some instances, users spin the mop with sufficient force to allow centrifugal forces move the plates outward. In both instances, the manual movement and spinning of the mops requires the user to waste time and effort, which slows the cleaning process, adds undue stress on the user, and increases the training and education required.

Other prior art foldable mops have added complex and costly springs to the carrier plates to bias the plates towards the unfolded position. In addition to adding cost and complexity to the mop, the present disclosure has found that such springs are either too hard so as to not allow the mop with the cleaning cloth to easily fit into the mop press or too soft so as to not sufficiently bias the carrier to the unfolded position.

Accordingly, it has been determined by the present disclosure that there is a continuing need for foldable flat mops that overcome, alleviate, and/or mitigate the aforementioned and other deleterious effects of prior art foldable flat mops.

SUMMARY

A foldable flat mop is provided that has a pair of carrier plates, which define an unfolded position, a folded position with a minimum distance between the tips of the carrier plates, and a deflected position where the carrier plates are deflected towards one another to reduce the minimum distance between the tips. The foldable flat mop can include one or more biasing members that bias the carrier plates to an intermediate position between the folded and unfolded positions. The carrier plates can have a scissor-like arrangement with the tips of the carrier plates being on an opposite side of the centerline from that pivot axis of that carrier plate.

A flat mop is provided that includes a mop carrier configured to removably receive a cleaning cloth. The mop carrier has at least two carrier plates pivotally secured to one another for movement among an unfolded folded position, a folded position, and a deflected position. The at least two carrier plates form a generally flat bottom surface in the unfolded position and form generally x-shaped bottom surface in the folded position with outer tips of the at least two plates defining a minimum distance therebetween. In some embodiments, at least a portion of one of the two carrier plates is resiliently flexible so that the outer tips are closer to one another than the minimum distance in the deflected position.

A flat mop is also provided that includes a mop carrier configured to removably receive a cleaning cloth. The mop carrier has a connecting plate, a first outer plate with a first outer tip, and a second outer plate with a second outer tip. The first outer plate is secured to the connecting plate for movement about a first axis and the second outer plate being secured to the connecting plate for movement about a second axis. The first outer tip is on a first side of a centerline, but the first pivot axis is on a second, opposite side of the centerline. Similarly, the second outer tip is on the second side of the centerline, but the second pivot axis is on the first side of the centerline.

The above-described and other features and advantages of the present disclosure will be appreciated and understood by those skilled in the art from the following detailed description, drawings, and appended claims.

DETAILED DESCRIPTION

Figure 1:
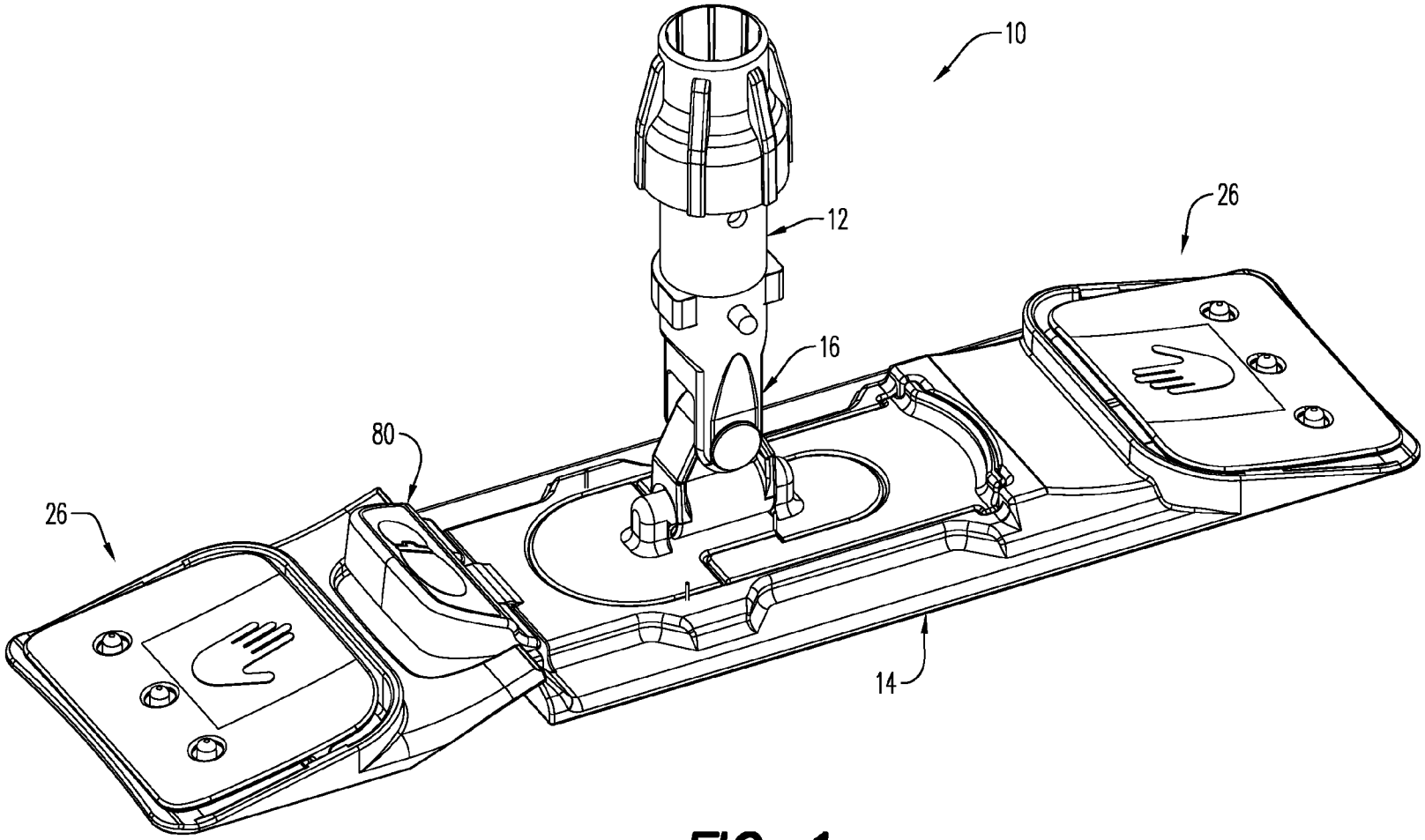
FIG. 1 is a perspective view of an exemplary embodiment of a foldable flat mop according to the present disclosure in an unfolded position.
Figure 2:
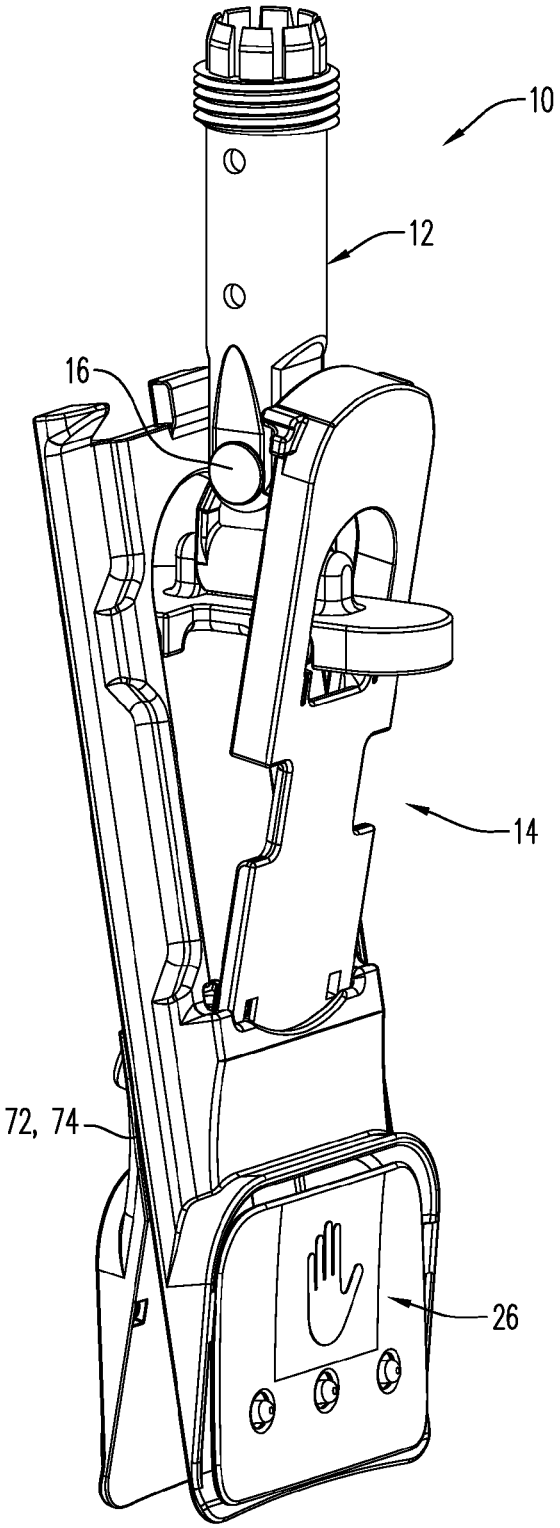
FIG. 2 is a perspective view of the mop of FIG. 1 in a folded position.

Referring to the drawings and in particular to FIGS. 1-2, an exemplary embodiment of a foldable flat mop ("mop") according to the present disclosure is shown and is generally referred to by reference numeral 10.

Mop 10 includes a handle 12 connected to a carrier 14 by a joint 16. Handle 12 is configured to receive a pole or extension (not shown), while carrier 14 is configured to removably receive a cleaning cloth, as will be described in more detail below. In this manner, the user can move carrier 14 by grasping handle 12, either directly or via the pole or extension, and can pass the cleaning cloth across a surface to be cleaned such that joint 16. Joint 16 can be any connection such as, but not limited to, a fixed connection, a resiliently flexible connection (e.g., a spring or elastomeric connection), a non-resilient connection that provides at least one, preferably more than one, degree of freedom (two shown) between the carrier and the handle.

Advantageously, mop 10 is configured to allow the user to easily move carrier 14 between a folded position and an unfolded position, with a minimum number of steps or manipulations, which increases cleaning efficiency and decreases effort particularly when the mop is used to clean large or heavily soiled areas requiring repeated movement of the carrier between these positions.

Figure 3:
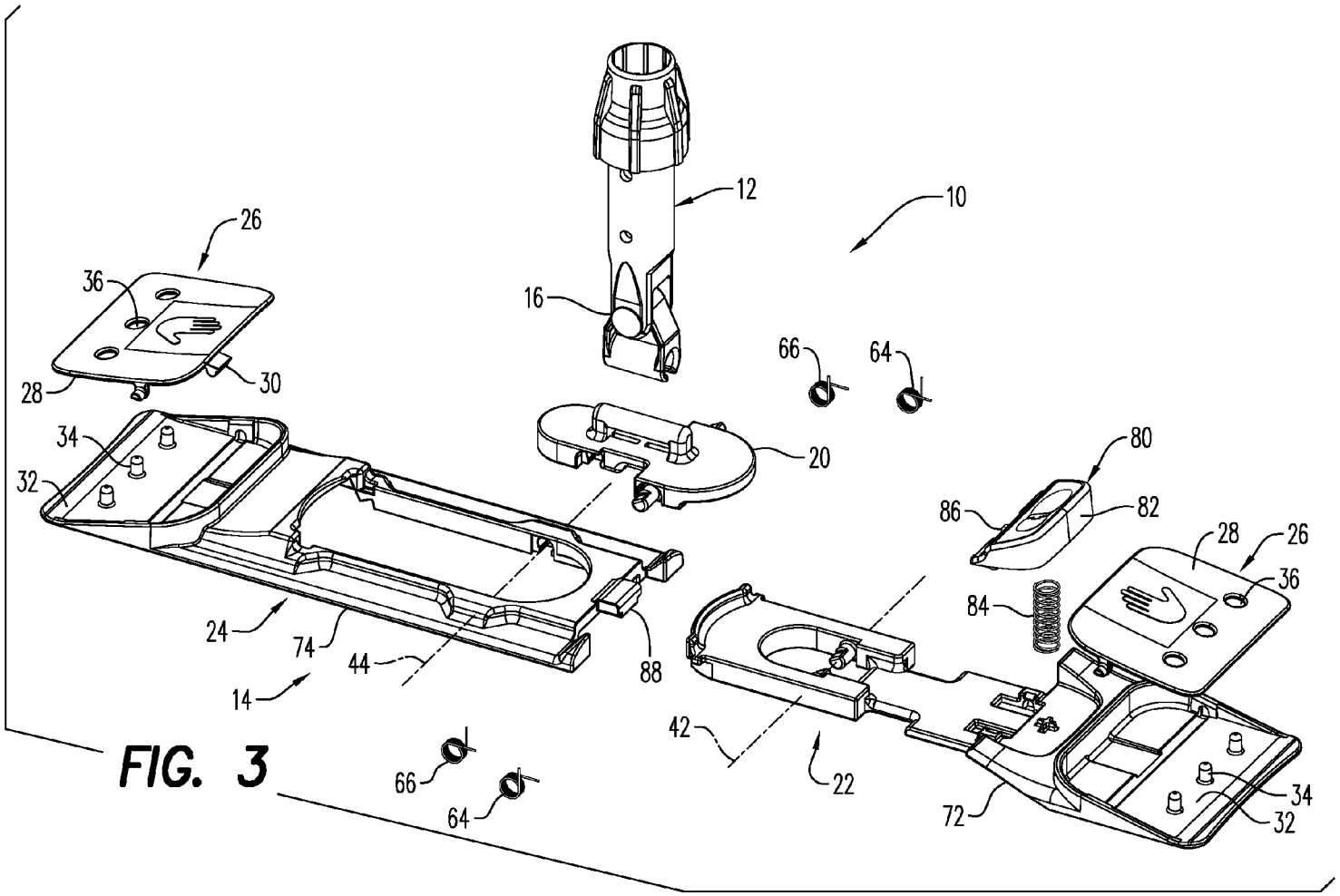
FIG. 3 is an exploded perspective view of the mop of FIG. 1.

Mop 10 is shown in more detail in FIG. 3. Again, mop 10 is shown having handle 12 and joint 16. Carrier 14 includes three plates, a connecting plate 20, a first outer plate 22, and a second outer plate 24. Connecting plate 20 is secured to joint 16, which is connected to handle 12. In the illustrated embodiment, joint 16 provides one or more degrees of freedom available between handle 12 and connecting plate 20.

First and second outer plates 22, 24 each include a cloth securing assembly 26, which allows the user to removably secure a cleaning cloth to carrier 14. In the illustrated embodiment, cloth securing assembly 26 includes a clamping arm 28 and a biasing member 30. Each clamping arm 28 is pivotally secured to a respective outer plate 22, 24. Biasing member 30 is configured to normally bias arm 28 about a pivot axis and against the respective plate 22, 24 with sufficient force to hold an end of the cleaning cloth between the arm and a clamping surface 32 of the plates.

Biasing member 30 is shown as being integrally molded with clamping arm 28. Of course, it is contemplated by the present disclosure for assembly 26 to have any biasing member arrangement sufficient to secure the cleaning cloth to carrier 14 such as but not limited to a coil spring, a torsion spring, a flat spring, and other biasing member. In the embodiment illustrated where biasing member 30 is integrally molded with clamping arm 28, the arm is molded of a material having sufficient strength and resiliency to allow member 30 to deflect to a depressed position to open a space between the arm and clamping surface 32, but return to the arm into contact with the clamping surface due to the resiliency of the materials.

In some embodiments, plates 22, 24 can include one or more protrusions 34 (three shown) on clamping surface 32 that cooperate with a corresponding number of indentations or openings 36 (three shown) in arms 28. Here, the cleaning cloth can include similar openings that allow protrusions 34 to pass through the cleaning cloth and the openings 36 when arm 28 is biased against surface 32 to secure the cloth to carrier 14.

The pivoting movement of outer plates 22, 24 with respect to connecting plate 20 is described with simultaneous reference to FIGS. 3 through 12.

Carrier plate 14 is configured so that first outer plate 22 is pivotally connected to connecting plate 20 at a first axis 42 and so that second outer plate 24 is pivotally connected to the connecting plate 20 at a second axis 44. Accordingly, carrier 14 is configured to move among the unfolded position (FIGS. 3-4 and 8), a folded position (FIG. 6), and a deflected position (FIGS. 7 and 11).

Figure 4:
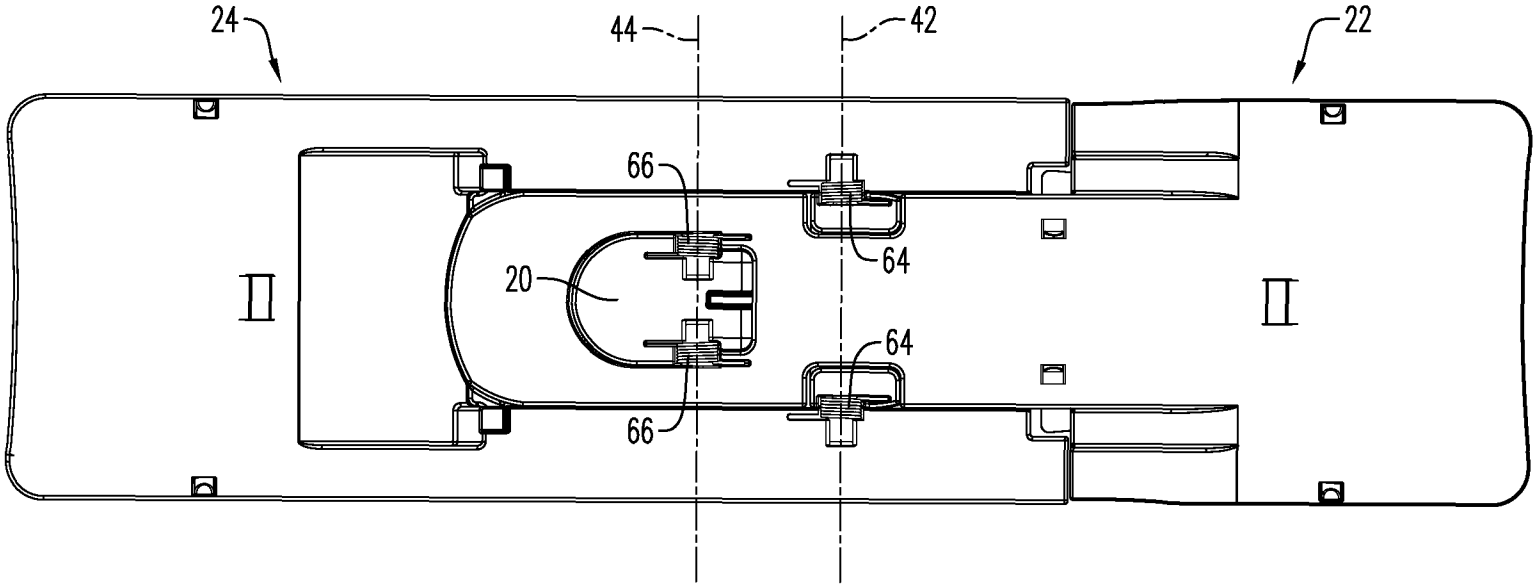
FIG. 4 is a bottom view of the mop of FIG. 1.
Figure 8:
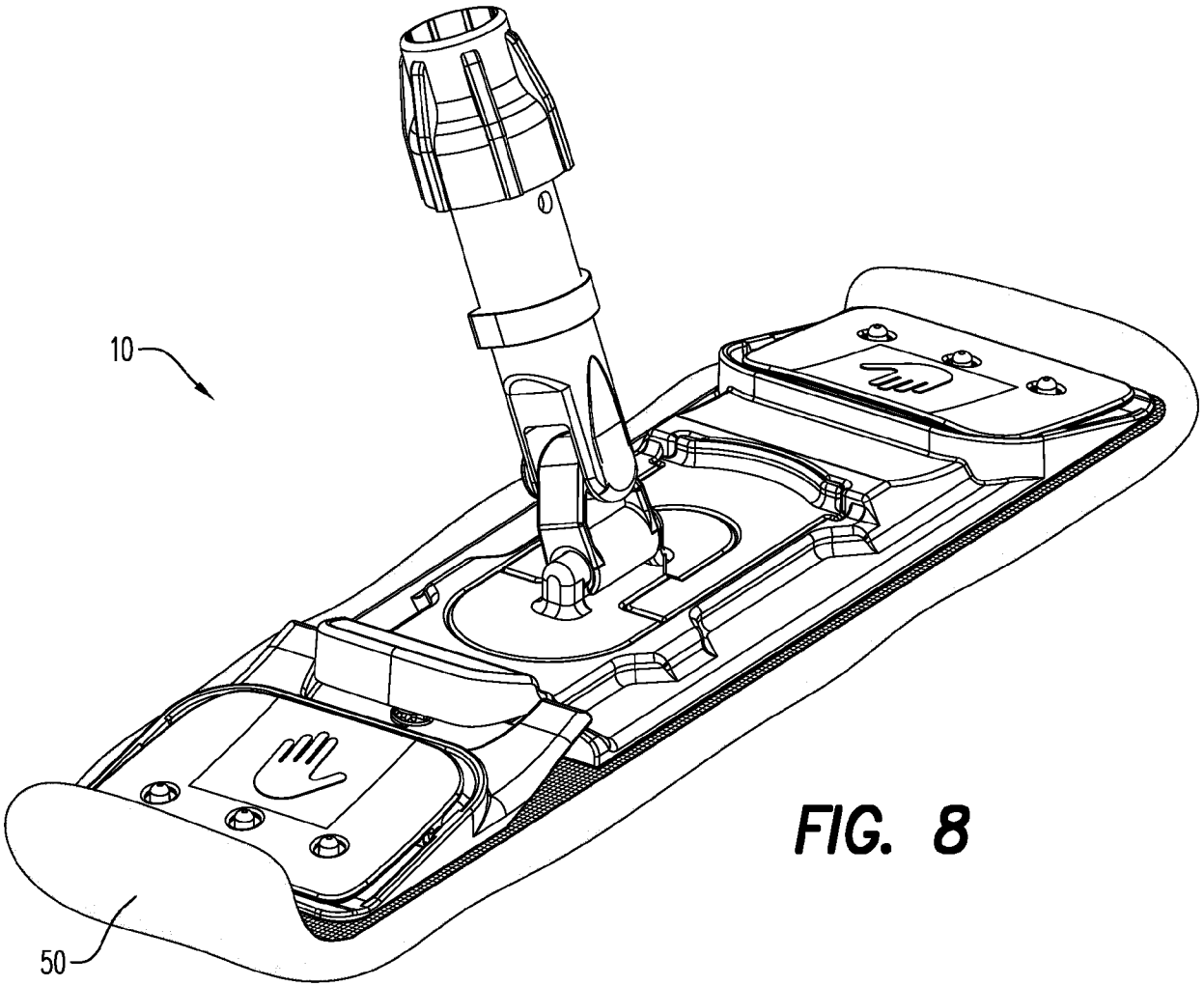
FIG. 8 is a perspective view of the mop of FIG. 1 in the unfolded position in use with a cleaning cloth.
Figure 9:
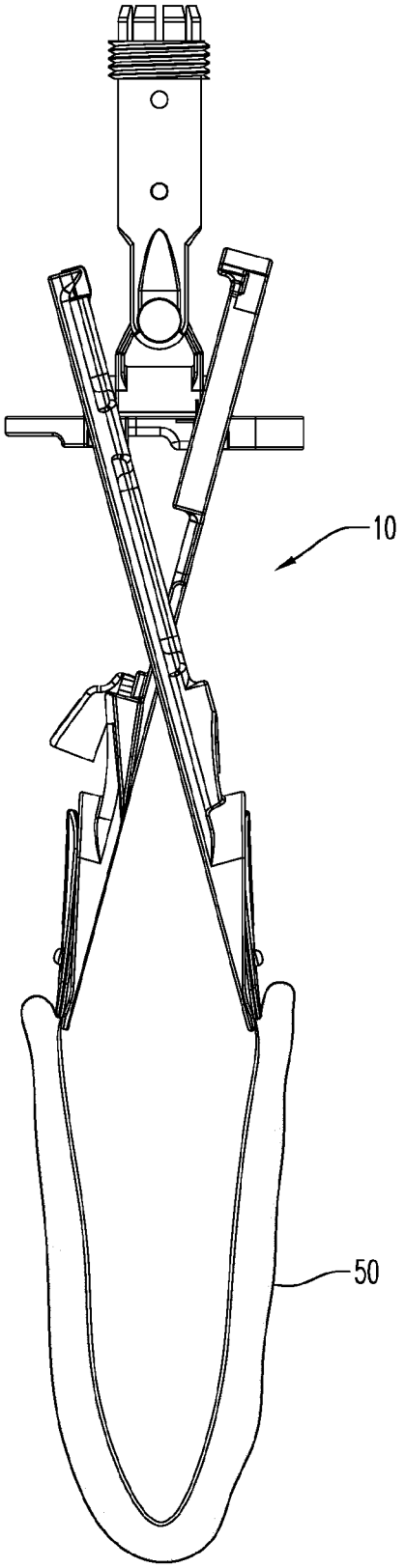
FIG. 9 is a perspective view of the mop of FIG. 1 in the intermediate position in use with the cleaning cloth.

In the unfolded position of FIGS. 3-4 and 8, carrier 14 forms a generally flat bottom surface to allow the user to use mop 10 having cleaning cloth 50 thereon in a known manner.

Figure 6:
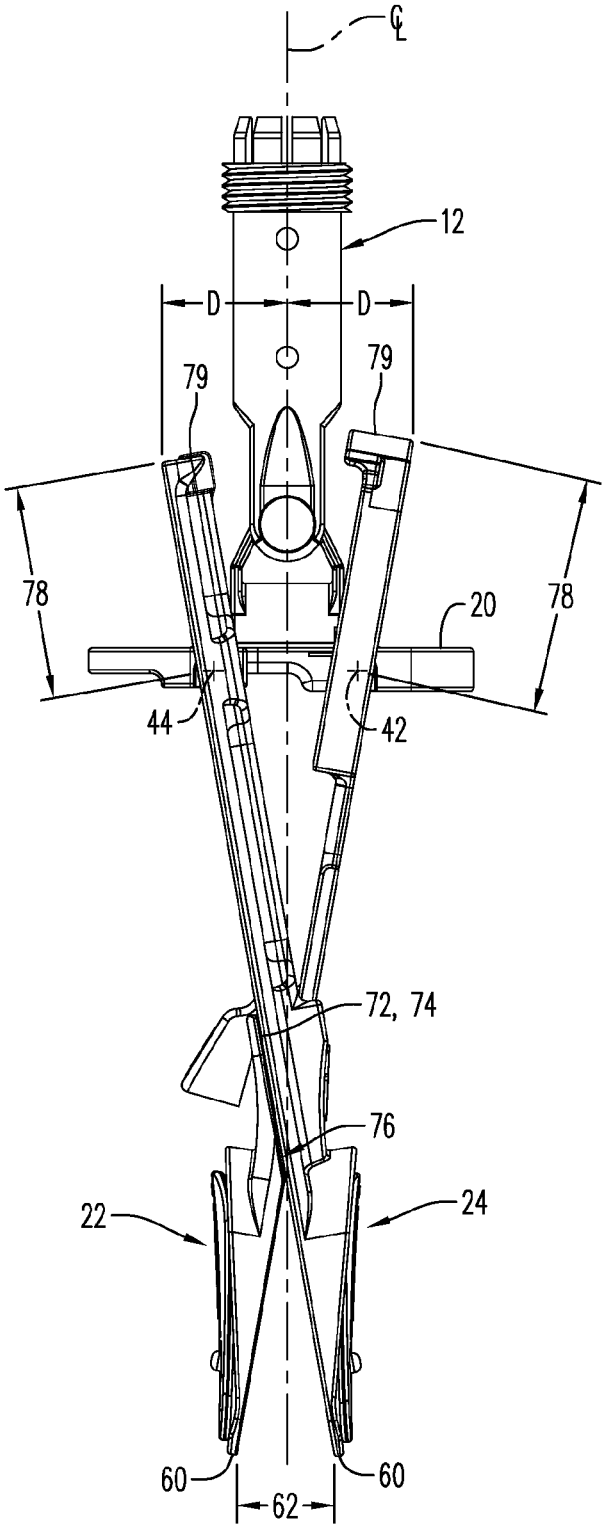
FIG. 6 is a side view of the mop of FIG. 1 in the folded position.
Figure 10:
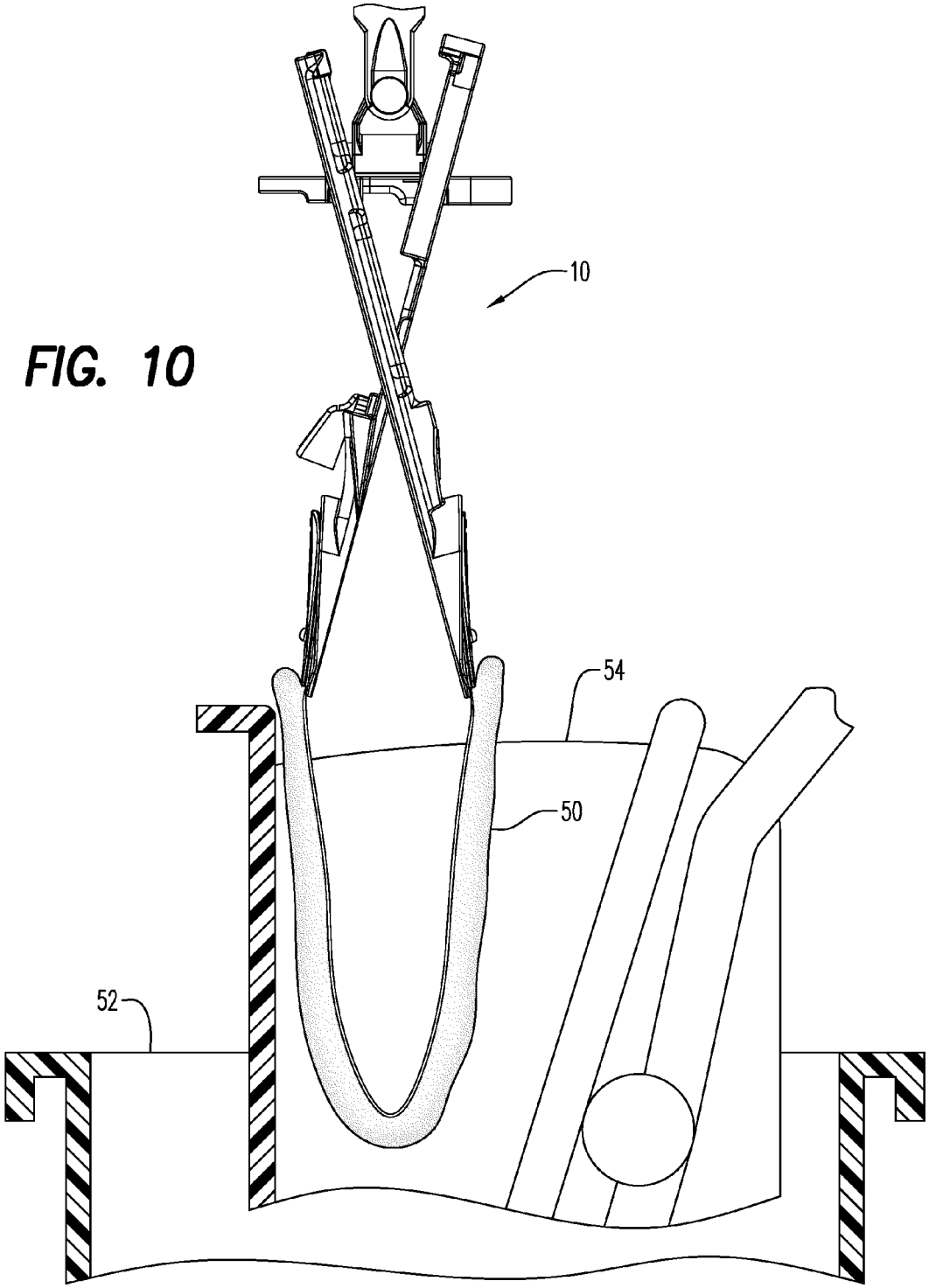
FIG. 10 is a perspective view of the mop of FIG. 1 in the intermediate position in use with a mop press.

In the folded position of FIG. 6, carrier 14 forms a generally x-shaped bottom surface that allows the user to dip cleaning cloth 50, which is hanging therefrom, in a bucket 52 having a rinsing and/or cleaning solution and to present the cloth to a mop press 54 on the bucket as in FIG. 10. The x-shaped bottom surface is defined as the portion of carrier 14 between axes 42, 44 and outer tips 60 of plates 22, 24.

Figure 7:
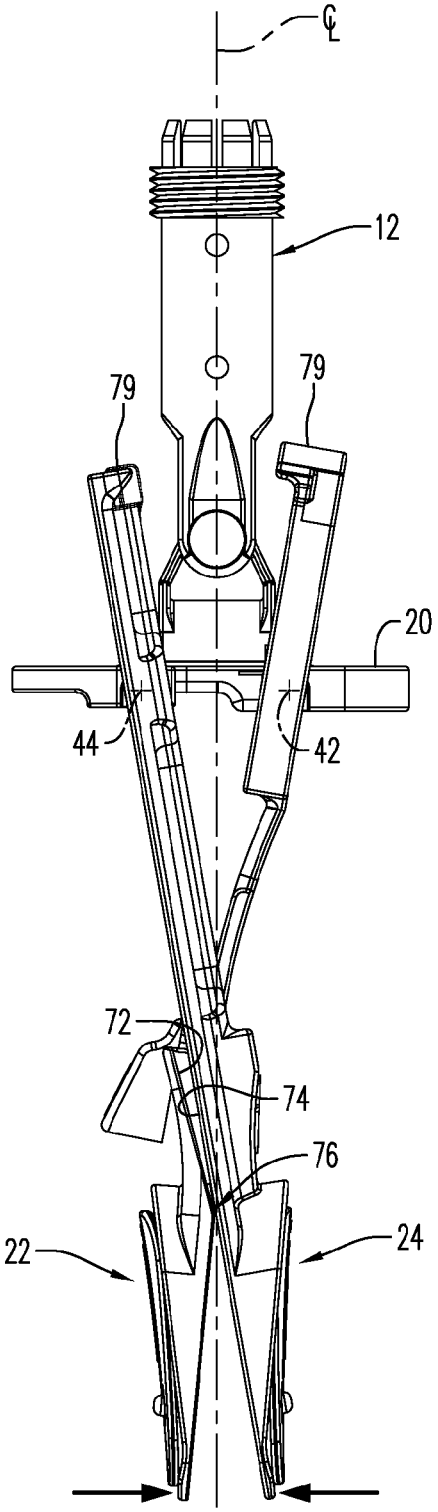
FIG. 7 is a side view of the mop of FIG. 1 in a deflected position.
Figure 11:
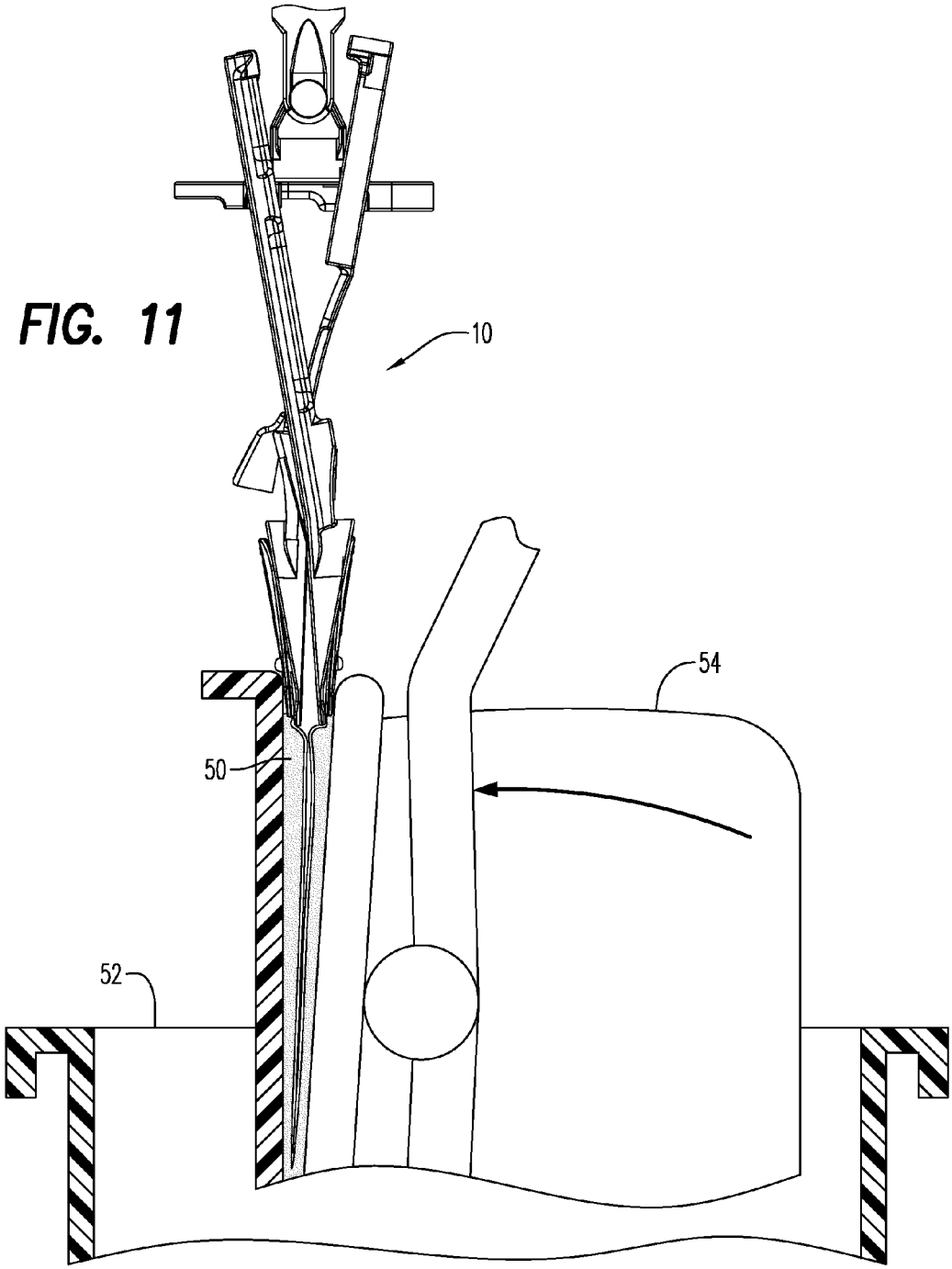
FIG. 11 is a perspective view of the mop of FIG. 1 in the deflected position due to the mop press.

In the deflection position of FIGS. 7 and 11, carrier 14 is configured to allow at least one of outer plates 22, 24 to deflect until outer tips 60 of the plates contact one another. In has been determined by the present disclosure that movement of carrier to deflected position allows mop press 54 to press excess fluid from cloth 50.

However, it has also been determined by the present disclosure that it is necessary to maintain tips 60 spaced apart from one another a minimum distance 62, as shown in FIG. 6, which allows the user to easily move carrier 14 back to the unfolded position. In this manner, a closing force (F) applied generally parallel to the centerline to one or both of tips 60 acts to move carrier 14 from the folded position to the unfolded position. In many instances, the closing force (F) can be easily applied by simply contacting tips 60, with the cleaning cloth thereon, against the surface to be cleaned.

Advantageously, carrier 14 is configured with a scissor-like movement between the folded and unfolded positions that provides the generally x-shaped bottom surface described above.

The scissor-like movement is described with reference to FIG. 5 where carrier 14 is illustrated having a centerline (C/L) drawn between the two pivot axes 42, 44. Specifically, carrier 14 is configured so that tip 60 of first outer plate 22 is on the left-hand side of the centerline, while pivot axis 42 for the first outer plate is on the right-hand side of the centerline. Similarly, carrier 14 is configured so that tip 60 of second outer plate 24 is on the right-hand side of the centerline, while pivot axis 44 for the second outer plate is on the left-hand side of the centerline.

It should be recognized that carrier 14 is illustrated by way of example only having the centerline drawn through the connection of joint 16 and connecting plate 20. Of course, it is contemplated by the present disclosure for the centerline to be positioned anywhere through connecting plate 20 to provide the aforementioned scissor-like movement.

Without wishing to be bound by any particular theory, it has been determined that placement of the pivot axis 42, 44 on the opposite side of the centerline with respect to the tip 60 of the corresponding outer plate 22, 24 provides a mechanical advantage to moving carrier 14 among the folded, unfolded, and deflected positions. The mechanical advantage is believed to be a result of an increase in the length of the lever arm formed by moving the pivot axis 42, 44 on the opposite side of the centerline with respect to the tip 60 of the corresponding outer plate 22, 24.

Accordingly, the structure of mop 10 provides a resulting angle to plates 22, 24 so that tips 60 remain separated from one another by distance 62 to allow the mop to easily move from the folded to the unfolded position. Specifically, it has been determined that maintaining tips 60 open by minimum distance 62, instead of allowing plates 22, 24 to hang vertically, allow the mop to move from the folded to the unfolded position with very little user effort.

Additionally in some embodiments, it is contemplated for carrier 14 to further include one or more biasing members 64 (two shown) at first axis 42, one or more biasing members 66 (two shown) at second axis 44, or biasing members 64, 66 at both axes 42, 44. Here, biasing members 64, 66 are configured to bias carrier to an intermediate position of FIGS. 5, 9-10, and 12.

Figure 5:
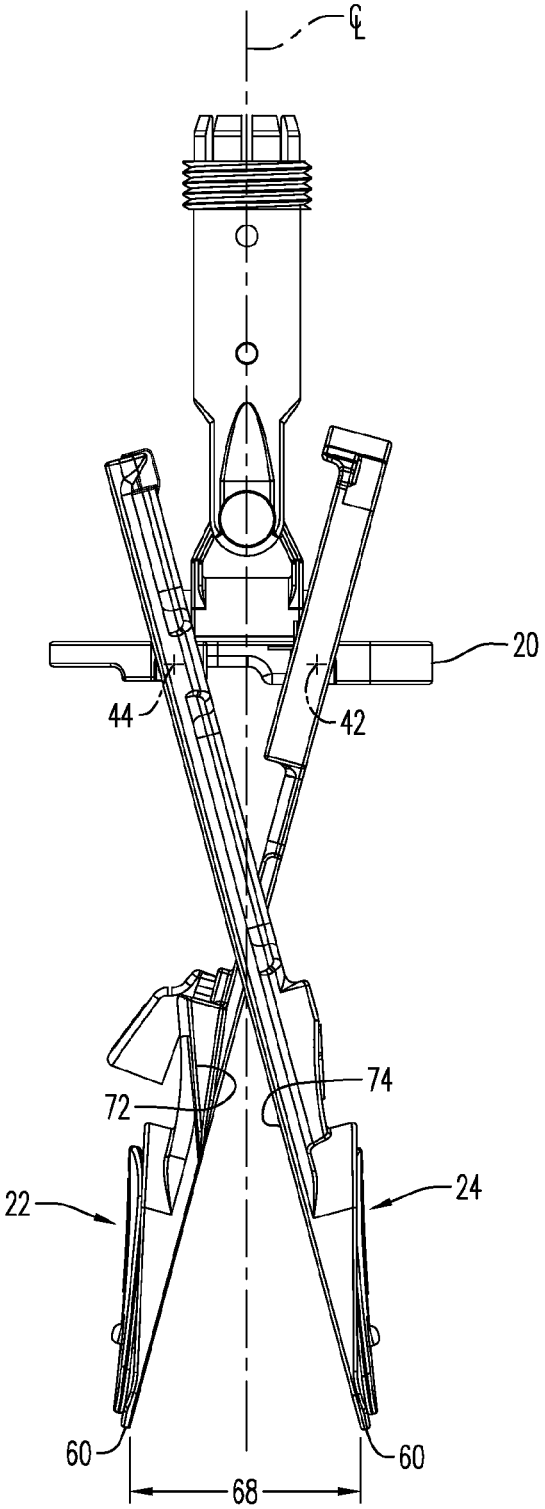
FIG. 5 is a side view of the mop of FIG. 1 in an intermediate position, which is between the folded and unfolded positions.

Biasing members 64, 66 are configured to bias first and second outer plates 22, 24 so that tips 60 are maintained at an intermediate distance 68 as shown in FIG. 5, where the intermediate distance is larger than minimum distance 62. It has also been determined by the present disclosure that maintaining tips 60 spaced apart from one another by intermediate distance 68, as shown in FIG. 5, can even further assist the user in moving carrier 14 back to the unfolded position.

Additionally, biasing members 64, 66 are configured to allow forces applied to first and second outer plates 22, 24, such as those applied by mop press 54 or even just the weight of cleaning cloth 50, to overcome the spring force so that tips 60 move to the minimum distance 62. Thus in some embodiments, the intermediate distance 68 can vary—for example—based upon the weight of the cleaning cloth 50 as a result of its saturation level and how much water/cleaning solution the cleaning cloth can hold.

Again and without wishing to be bound by any particular theory, it has been determined that placement of the pivot axis 42, 44 on the opposite side of the centerline with respect to the tip 60 of the corresponding outer plate 22, 24 provides a further mechanical advantage to biasing members 64, 66 in moving carrier 14 to the intermediate position.

Biasing members 64, 66 are illustrated by way of example as torsion springs. Of course, it is contemplated by the present disclosure for biasing members 64, 66 to be any member capable of biasing tips 60 away from minimum distance 68. Thus, it is contemplated by the present disclosure for biasing members 64, 66 to include torsion members, compression members, extension members, leaf members, and other biasing members.

Figure 12:
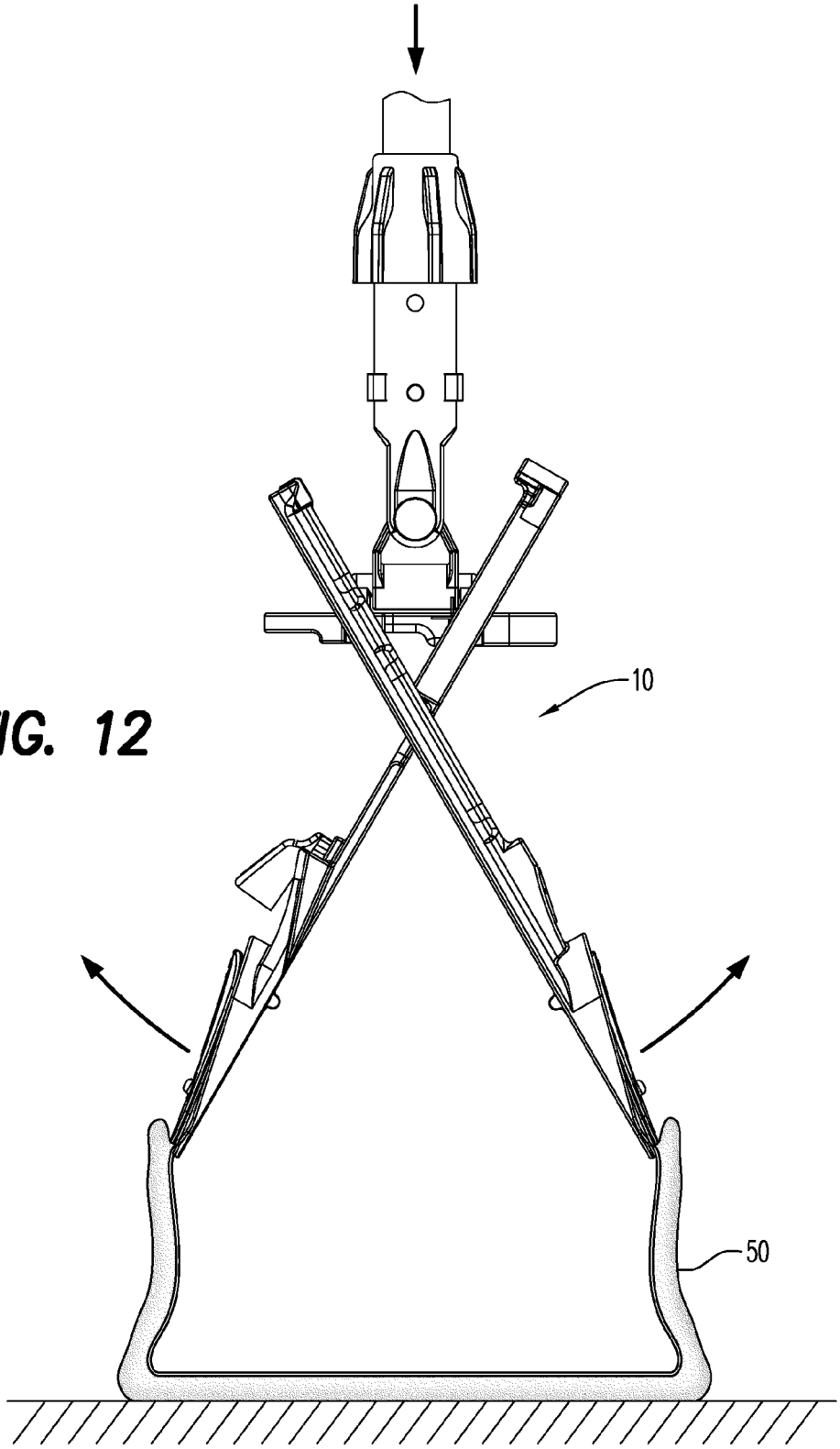
FIG. 12 is a perspective view of the mop of FIG. 1 as the carrier plates move from the intermediate position towards the unfolded position.

Accordingly, it has been determined by the present disclosure that mop 10, via carrier 14 having the folded position with predetermined minimum distance 62 between tips 60 of FIG. 6 or, when biasing members 64, 66 are present, having the intermediate position with the intermediate distance 68 between the tips of FIG. 5, can be easily moved back to the unfolded position of FIG. 8 by simply pressing the mop downward against the surface to be cleaned. The movement of carrier to the unfolded position by simple downward pressing or movement is illustrated in FIG. 12.

Stated another way, by establishing a predetermined minimum distance 62 between tips 60 and, in some embodiments establishing intermediate distance 68, mop 10 maintains the tips a sufficient distance apart from one another so as to allow the simple application of a downward force on carrier 14 via handle 12 to cause outer plates 22, 24 to pivot with respect to connecting plate 20 about axes 42, 44 respectively, until the plates reach the unfolded position. Moreover by allowing deflection of tips 60 past the predetermined minimum distance 62, mop 10 is configured to allow a more complete pressing of fluids from cloth 50.

The minimum distance 62 of FIG. 6, when carrier 14 is in the folded position, is established by a set of corresponding first and second stops 72, 74 on first and second outer plates 22, 24, respectively. Here, first stop 72 of first outer plate 22 abuts or interferes with second stop 74 of second outer plate 24 with the stops positioned below axes 42, 44.

In the illustrated embodiment, second stop 74 is simply the bottom surface of the second outer plate 24. Of course, other arrangements of first and second stops 72, 74 that establish minimum distance 62 are contemplated by the present disclosure.

It should be recognized that it is contemplated by the present disclosure for carrier 14 to have no biasing members 64, 66 but rather to only have stops 72, 74. In such embodiments, mop 10 lacks the intermediate position established by the members.

Advantageously, stops 72, 74 also act as a fulcrum 76 for the deflection of first and second outer plates 22, 24 as shown in FIGS. 7 and 11. Thus, carrier 14 has been configured so that fulcrum 76 is remote enough from axes 42, 44 to allow for the deflection of tips 60 to the deflected position, yet sufficiently proximate to the axes 42, 44 so as to establish the minimum distance 62.

In some embodiments and as shown in FIG. 6, outer plates 22, 24 have an upper length 78 that is minimized, where the upper length is the portion of the plates that extends above axis 42, 44 in a direction away from tips 60. It has been determined by the present disclosure that minimization of upper length 78 can ensure that the upper tips 79 of plates 22, 24 remain close to centerline (CL) when in the folded position—namely by a distance (D). When the distance (D) of upper tips 79 extends too far from centerline (CL), the upper tips can become difficult to remove from the mop press after rinsing the mop as the mop goes below the press.

Carrier 14 is made of a material having sufficient strength and resiliency to allow tips 60 to deflect to the deflected position, but return to minimum distance 62 due to the resiliency of the materials. For example, it is contemplated by the present disclosure for carrier 14 to be made of polymer materials such as, but not limited to polypropylene (PP), nylon, and polyoxymethylene (POM), where such materials can be provided with one or more fillers such as, but not limited to talc and glass. It should be recognized that carrier 14 is described above illustrating outer plates 22, 24 deflecting to the deflected position. Of course, it is contemplated by the present disclosure for the deflection to be a result of flexion in one or more of connecting plate 20, first outer plate 22, second outer plate 24, the connections therebetween, and any combinations thereof.

It should be recognized that mop 10 is described above by way of example only as having carrier 14 with three plates, connecting plate 20 and outer plates 22, 24. Of course, it is contemplated by the present disclosure for carrier 14 to have as many plates as desires such as, but not limited to two plates or more than three plates.

Moreover, it is contemplated by the present disclosure for plates 20, 22, and 24 to be configured in any desired manner so that axes 42, 44 provide the x-shaped bottom surface or scissor-like movement described above. Thus, it is contemplated by the present disclosure for the x-shaped bottom surface or scissor-like movement to be symmetrical as illustrated or unsymmetrical.

In some embodiments, carrier 14 can further include a lock assembly 80, which releasably secures the carrier in the unfolded position, yet allows the user to easily release the carrier for movement to the folded position or, when biasing members 64, 66 are present, to the intermediate position.

Lock assembly 80 has a release button 82 on an upper surface of carrier 14. Release button 82 is, preferably, of sufficient size and prominence to allow the user to activate the button with their foot. Once button 82 has been activated, outer plates 22, 24 can be easily moved from the unfolded position to the folded/intermediate position by simply lifting carrier from the surface being cleaned. Moreover and when moving carrier 14 back to the unfolded position, lock assembly 80 is configured to re-secure plates 22, 24 once the plates have been moved to the unfolded position.

In this manner, carrier 14 is configured to be easily locked in the unfolded position and unlocked from the unfolded position with simple, efficient movements—namely pushing the carrier into the unfolded position with pressure on handle 12 to secure the carrier in the unfolded position and activating button 82 with their foot, then lifting the carrier from the surface being cleaned, respectively.

Figure 3A:
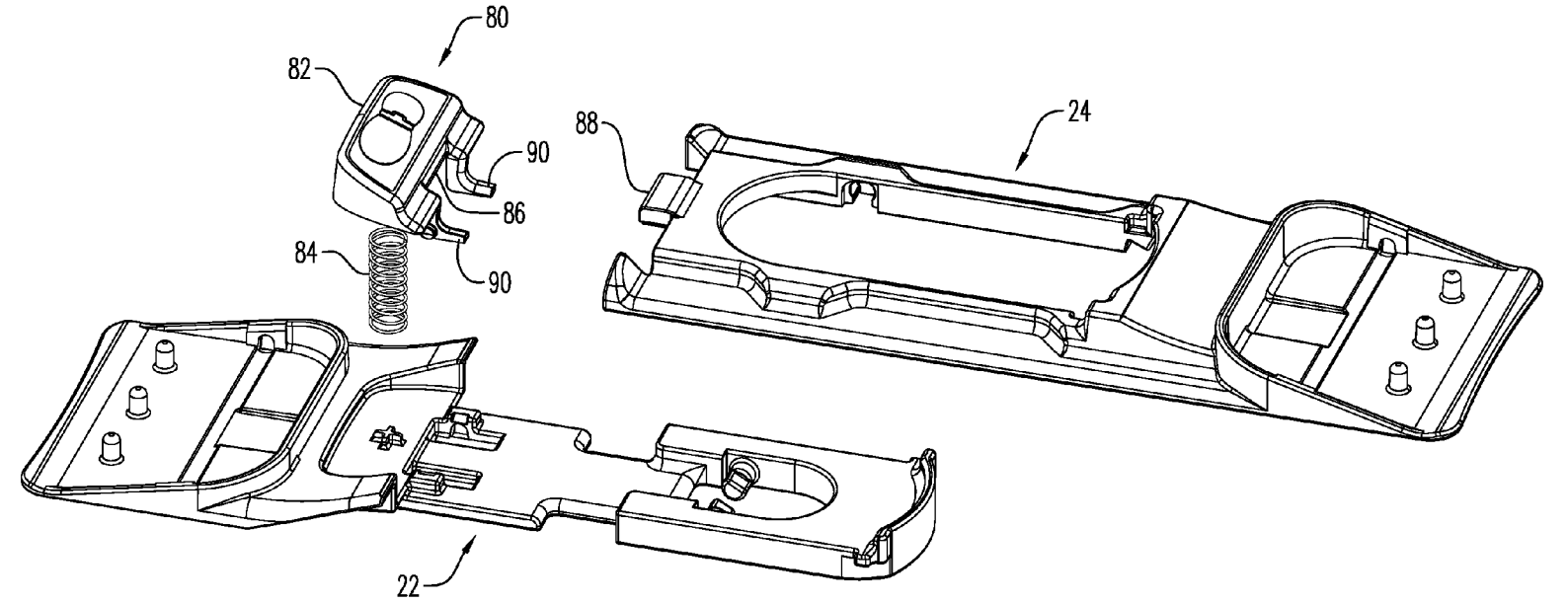
FIG. 3A is an exploded perspective view of a lock assembly according to the present disclosure for use with the mop of FIG. 1.

Lock assembly 80 is described in more detail with reference to FIGS. 3 and 3A. In addition to button 82, lock assembly 80 further includes a biasing member 84, a first locking surface 86 on the button, a second locking surface 88 on second outer plate 24, and one or more leverage members 90 (two shown) on the button.

Button 82 is pivotally secured to first outer plate 22 such that biasing member 84 normally biases first locking surface 86 to a downward or locked position.

In the unfolded position, second locking surface 88 is captured under first locking surface 86 and leverage member 90 is captured between first and second outer plates 22, 24. In this position, movement of first and second outer plates 22, 24 from the unfolded position towards the intermediate or folded positions is prevented by abutment of first and second locking surfaces 86. Thus when carrier 14 is in the unfolded position, second locking surface 88 abuts or is captured by first locking surface 86 to prevent movement of the first and second outer plates 22, 24 about axes 42, 44.

When a user applies a force to button 82 sufficient to overcome the spring force of biasing member 84, the button pivots so that first locking surface 86 moves upward away from first outer plate 22 a distance sufficient to allow second locking surface 88 to no longer abut or interfere with first locking surface 86 such that first and second outer plates 22, 24 can be rotated about axes 42, 44.

Additionally as button 82 pivots, leverage member(s) 90 act on a bottom surface of second outer plate 24 to assist the movement of first and second outer plates 22, 24 about axes 42, 44 towards the folded position.

When moving carrier 14 from the folded position to the unfolded position, the bottom surface of second outer plate 24 acts on leverage member(s) 90 to pivot button 82 back to the locked position as second locking surface 88 is captured under first locking surface 86.

Advantageously, lock assembly 80 directly secures first and second outer plates 22, 24 to one another and, in some instances provides leverage member(s) 90 to assist in moving the plates from the unfolded position.

Accordingly, mop 10 is configured to allow the user to easily move carrier 14 between the folded and unfolded positions, with a minimum number of steps or manipulations, which increases cleaning efficiency and decreases effort.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A flat mop comprising:

a mop carrier configured to removably receive a cleaning cloth, the mop carrier having two carrier plates each pivotally secured to a connecting plate for movement among an unfolded position, a folded position, and a deflected position, and wherein the two carrier plates and the connecting plate form a generally flat bottom surface in the unfolded position, and wherein the two carrier plates form a generally x-shaped bottom surface with each other in the folded position with outer tips of the at least two plates defining a minimum distance therebetween.

2. The flat mop of claim 1, further comprising a handle and a joint securing the mop carrier to the handle.

3. The flat mop of claim 2, wherein the joint is selected from the group consisting of a fixed connection, a resiliently flexible connection, and a non-resilient connection that provides at least one degree of freedom between the mop carrier and the handle.

4. The flat mop of claim 1, wherein at least one of the two carrier plates have a portion that is resiliently flexible so that the outer tips are closer to one another than the minimum distance in the deflected position.

5. The flat mop of claim 1, wherein the outer tips contact one another in the deflected position.

6. The flat mop of claim 1, further comprising a cloth securing assembly that removably secures the cleaning cloth to the two carrier plates.

7. The flat mop of claim 1, further comprising a lock assembly that releasably secures the two carrier plates in the unfolded position.

8. The flat mop of claim 2, wherein the two carrier plates comprise a first outer plate and a second outer plate, the connecting plate being secured to the joint, the first outer plate being secured to the connecting plate for movement about a first axis, and the second outer plate being secured to the connecting plate for movement about a second axis.

9. The flat mop of claim 8, wherein the outer tip of the first outer plate is on a first side of a centerline, the first pivot axis is on a second, opposite side of the centerline, the outer tip of the second outer plate is on the second side of the centerline, and the second pivot axis is on the first side of the centerline.

10. The flat mop of claim 8, further comprising a biasing member at the first axis, at the second axis, or at both the first and second axes, the biasing member being configured to bias the first and/or second outer plates to an intermediate position, the intermediate position being between the unfolded and the folded positions so that the outer tips are spaced apart by an intermediate distance that is larger than the minimum distance.

11. The flat mop of claim 8, further comprising a first stop on the first outer plate and a second stop on the second outer plate, the first and second stops abut or interfere with one another to establish the folded position.

12. The flat mop of claim 11, wherein the first and second stops abut or interfere with one another at a position below the first and second axes.

13. The flat mop of claim 11, wherein the first and second stops abut or interfere to form a fulcrum for deflection of the first and second outer plates in the deflected position.

14. A flat mop comprising:

a mop carrier configured to removably receive a cleaning cloth, the mop carrier having a connecting plate, a first outer plate with a first outer tip, and a second outer plate with a second outer tip, the first outer plate being secured to the connecting plate for movement about a first axis, and the second outer plate being secured to the connecting plate for movement about a second axis, wherein the first outer tip is on a first side of a centerline, the first pivot axis is on a second, opposite side of the centerline, the second outer tip is on the second side of the centerline, and the second pivot axis is on the first side of the centerline.

15. The flat mop of claim 14, further comprising a handle and a joint, wherein the connecting plate is secured to the joint.

16. The flat mop of claim 15, wherein the joint is selected from the group consisting of a fixed connection, a resiliently flexible connection, and a non-resilient connection that provides at least one degree of freedom between the connecting plate and the handle.

17. The flat mop of claim 14, wherein the mop carrier is configured for movement among an unfolded position, a folded position, and a deflected position.

18. The flat mop of claim 17, wherein the connecting, first outer, and second outer plates form a generally flat bottom surface in the unfolded position and a generally x-shaped bottom surface in the folded position with the first and second outer tips defining a minimum distance therebetween.

19. The flat mop of claim 18, wherein at least one of the connecting, first outer, and second outer plates has a portion that is resiliently flexible so that the first and second outer tips are closer to one another than the minimum distance in the deflected position.

20. The flat mop of claim 19, wherein the first and second outer tips contact one another in the deflected position.

21. The flat mop of claim 18, further comprising a biasing member at the first axis, at the second axis, or at both the first and second axes.

22. The flat mop of claim 21, wherein the biasing member is configured to bias the first and/or second outer plates to an intermediate position, the intermediate position being between the unfolded and the folded positions so that the outer tips are spaced apart by an intermediate distance that is larger than the minimum distance.

23. The flat mop of claim 14, further comprising a first stop on the first outer plate and a second stop on the second outer plate, the first and second stops abut or interfere with one another to establish the folded position and form a fulcrum for deflection of the first and second outer plates in the deflected position.

24. The flat mop of claim 23, wherein the first and second stops abut or interfere with one another at a position below the first and second axes.

25. A flat mop comprising:

a mop carrier having a connecting plate, a first outer plate, and a second outer plate, wherein the first outer plate is secured to the connecting plate for movement about a first axis and the second outer plate is secured to the connecting plate for movement about a second axis so that the first and second carrier plates move between an unfolded position and a folded position, wherein the first outer plate has a first stop and the second outer plate has a second stop, the first and second stops abut or interfere with one another to establish the folded position with a minimum distance between outer tips of the first and second outer plates, and wherein the first and second stops abut or interfere with one another at a position below the first and second axes.

26. The flat mop of claim 25, further comprising a handle and a joint, wherein the connecting plate is secured to the joint.

27. The flat mop of claim 26, wherein the joint is selected from the group consisting of a fixed connection, a resiliently flexible connection, and a non-resilient connection that provides at least one degree of freedom between the connecting plate and the handle.

28. A flat mop comprising:

a mop carrier having a connecting plate, a first outer plate, and a second outer plate, wherein the first outer plate is secured to the connecting plate for movement about a first axis and the second outer plate is secured to the connecting plate for movement about a second axis so that the first and second carrier plates move between an unfolded position and a folded position, wherein the first outer plate has a first stop and the second outer plate has a second stop, the first and second stops abut or interfere with one another to establish the folded position with a minimum distance between outer tips of the first and second outer plates, and wherein the first and second stops abut or interfere to form a fulcrum for deflection of the first and second outer plates to define a deflected position where the outer tips are closer to one another than the minimum distance.

* * * * *